US011002078B2

(12) United States Patent
Russell

(10) Patent No.: US 11,002,078 B2
(45) Date of Patent: May 11, 2021

(54) APPARATUS FOR PROVIDING DIRECTIONAL CONTROL OF BORE DRILLING EQUIPMENT

(71) Applicant: SLIP CLUTCH SYSTEMS LTD, Gloucestershire (GB)

(72) Inventor: Michael King Russell, Gloucestershire (GB)

(73) Assignee: Slip Clutch Systems LTD, Gloucestershire (GB)

( * ) Notice: Subject to any disclaimer, the term of this patent is extended or adjusted under 35 U.S.C. 154(b) by 298 days.

(21) Appl. No.: 16/069,701

(22) PCT Filed: Jan. 13, 2016

(86) PCT No.: PCT/GB2016/050074
§ 371 (c)(1),
(2) Date: Jul. 12, 2018

(87) PCT Pub. No.: WO2017/121976
PCT Pub. Date: Jul. 20, 2017

(65) Prior Publication Data

US 2019/0048664 A1 Feb. 14, 2019

(51) Int. Cl.
*E21B 7/06* (2006.01)

(52) U.S. Cl.
CPC ..... *E21B 7/062* (2013.01); *E21B 7/06* (2013.01)

(58) Field of Classification Search
CPC ..... E21B 7/04; E21B 7/06; E21B 34/00–16; E21B 7/062
See application file for complete search history.

(56) References Cited

U.S. PATENT DOCUMENTS 3,841,420 A 10/1974 Russell
5,485,889 A 1/1996 Gray
(Continued)

FOREIGN PATENT DOCUMENTS

CN 102892970 A 1/2013
CN 102923126 A 2/2013
(Continued)

OTHER PUBLICATIONS

Chinese Patent Application No. 201680078890.5 Office Action dated Aug. 27, 2019 (17 pages).
(Continued)

*Primary Examiner* — Giovanna Wright
*Assistant Examiner* — Dany E Akakpo
(74) *Attorney, Agent, or Firm* — Conley Rose, P.C.

(57) ABSTRACT

Apparatuses are disclosed for providing directional control of bore drilling equipment. In an embodiment, the apparatus includes a hydraulic pump having an input shaft for receiving an input torque from a drill pipe and being connected in use to a drilling head. In addition, the apparatus includes control arrangement for varying the rate of fluid flow through the pump. The control arrangement includes a closed loop oil-filled system including the hydraulic pump and a main valve. Oil from the pump is routed through the main valve before returning to a pump input. In addition, the control arrangement includes an orifice control system which is operable to control the position of the main valve in response to an input signal from a control processor.

16 Claims, 3 Drawing Sheets

(56) References Cited

U.S. PATENT DOCUMENTS

| | | | | |
|---|---|---|---|---|
| 2006/0090799 | A1 | 5/2006 | Achmad et al. | |
| 2008/0121432 | A1 | 5/2008 | Russell et al. | |
| 2010/0126774 | A1 | 5/2010 | Downton | |
| 2012/0018218 | A1 | 1/2012 | Rosenhauch | |
| 2012/0168230 | A1* | 7/2012 | Gocke | E21B 7/067 175/325.1 |
| 2013/0046417 | A1* | 2/2013 | Schroter | E21B 47/024 700/302 |
| 2016/0273321 | A1* | 9/2016 | Frosell | E21B 43/12 |
| 2018/0340374 | A1* | 11/2018 | Moore | E21B 7/062 |

FOREIGN PATENT DOCUMENTS

| | | | |
|---|---|---|---|
| CN | 104832088 | A | 8/2015 |
| EP | 1024245 | A2 | 8/2000 |
| GB | 2516339 | A | 1/2015 |
| GB | 2532304 | A | 5/2016 |
| WO | 2011/160027 | A2 | 12/2011 |
| WO | 2015/167458 | A1 | 11/2015 |
| WO | 2015/179307 | A1 | 11/2015 |

OTHER PUBLICATIONS

International Patent Application No. PCT/GB2016/050074 International Search Report and Written Opinion dated Nov. 23, 2016 (18 pages).
Brazilian Patent Application No. BR112018014131-3 Office Action dated Jun. 25, 2020 (6 pages).

* cited by examiner

APPARATUS FOR PROVIDING DIRECTIONAL CONTROL OF BORE DRILLING EQUIPMENT

CROSS-REFERENCE TO RELATED APPLICATIONS

This application is a National Phase Entry into the U.S. under 35 U.S.C. § 371 of and claims priority to PCT Application No. PCT/GB2016/050074 filed Jan. 13, 2016, and entitled "Apparatus For Providing Directional Control of Bore Drilling Equipment," the contents of which are incorporated herein by reference in their entirety.

STATEMENT REGARDING FEDERALLY SPONSORED RESEARCH OR DEVELOPMENT

Not applicable.

BACKGROUND

The present invention relates to an apparatus for providing directional control of bore drilling equipment and a method of providing directional control of bore drilling equipment.

In the drilling of bore holes, it is known to provide a drill pipe or "string" linked at an upstream end to a surface drilling rig. At a downstream end, the drill pipe is connected to a drilling head or a bottom hole assembly, commonly referred to as a BHA. In early drilling arrangements, the rotating drive of the drilling rig was rigidly connected to the drill bit directly via the drill pipe, and control of bore hole direction was very limited. Attempts to control direction were made via mechanical wedges (Whipstocks) and these were often positioned by drill pipe mechanical manipulation.

Further advances in directional control used downhole mud driven motors with bent housings connected to the downhole end of the drill pipe. In this arrangement, the roll orientation of these motors is controlled by the drill pipe. The mud motors have a reaction torque which is taken via the drill pipe back to the surface drilling rig. With this configuration, bore hole deviation is controlled by manipulating the fixed drill pipe torsional position at the surface rig. This drilling arrangement uses a stationary drill pipe. This type of system is limited in extended reach drilling by the effect of longitudinal friction between non-rotating drill pipe and the bore hole.

A further development was to provide a mechanism for changing the orientation of the drilling head in situ in the bore hole. The drilling head (or BHA) is rotatably connected with respect to the downhole end of the drill pipe, and an example of such an arrangement is disclosed in the Applicant's earlier patent GB1268938.

Rotary steerable drilling systems are known, for example, in WO2011/160027; EP1024245; and EP2559841. In these rotary steerable drilling systems the drill pipe input is directly connected to the drilling motor or the drill bit. The drilling system steering is effected by surrounding the drill pipe input shaft by assemblies generally known as a bias unit. The bias units are often hydraulic driven assemblies and a hydraulic pump is used to power them. The hydraulic pump may be powered by a mud turbine, electric motor or by some other suitable known mechanical drive.

The applicant has previously proposed an arrangement for controlling the orientation of a BHA in which a motor is provided for driving the drill but. The drilling reaction torque is reacted against the drill pipe by control means. One arrangement includes a clutch for locking the head against rotation with respect to the drill pipe, the latter being held non-rotative in use. Another arrangement includes a torque converter, such a pump with variable loading, coupled to the drill pipe to be driven thereby, the drill pipe being continuously rotated from the surface in use.

An alternative method to provide directional control in bore drilling developed by the Applicant is described in GB0602623.1 and GB0712874.7. These devices include slipping clutch mechanizations mounted between the drill pipe and the drill head, such that torque from the drill pipe can be controllable applied to the drill head by varying the engagement of the clutch. These devices do not use the basic pump mechanization described above.

The current advancements in extended reach bore drilling use BHA arrangements running on rotating drill pipes and control information may be transmitted by variation of drill pipe rotational speed.

One problem with these systems is a torsional oscillatory motion called sticks slip. This motion cause difficulties in the control of rotary steerable systems and may involve excessive stress or even mechanical failures.

Typically during bore hole drilling, continuous measurements are sent from the downhole end to the control station at the surface. The drilling process involves alternating between drilling ahead (straight through drilling) and path correction drilling.

In straight-though drilling mode, with the BHA at a fixed angular position, maximum torque is applied to rotate the drill pipe to advance the down stream end of the drilling assembly to produce a straight bore. After a period of straight-through drilling, the drill pipe is halted and surveys are taken which give an indication of the current course with respect to intended course. If the current course corresponds to the intended course, the drilling continues in straight-through mode for a further defined period, before halting and surveying again. If the current position is off-course, then BHA position is adjusted accordingly and the drilling assembly is driven with a stationary (non-rotating) drill pipe in a course correction mode. Operation of the drill assembly in the course correction mode (with a stationary drill pipe) is extremely difficult and requires a high level of operator expertise. After a further period of drilling the drilling is halted, further surveys are taken and evaluated to determine whether further course adjustment is required or whether straight-through drilling can be resumed. If no deviation is required, straight through drilling is resumed in which the drill pipe is rotated with the BHA.

Embodiments of the invention seek to provide an apparatus which overcome some or all of these problems.

BRIEF SUMMARY

According to a first aspect of the present invention there is provided an apparatus for providing directional control of bore drilling equipment comprising:

a hydraulic pump having an input shaft for receiving an input torque from a drill pipe and being connected in use to a drilling head; and a control arrangement for varying the rate of fluid flow through the pump;

wherein the control arrangement includes:

a closed loop oil-filled system comprising the hydraulic pump and a main valve, wherein oil from the pump is routed through the main valve before returning to a pump input;

and an orifice control system operable to control the position of the main valve in response to an input signal from a control processor.

The hydraulic pump may be a positive displacement pump.

The orifice control system may comprise a control valve provided in the closed loop system and connected to the main valve. The control valve may be operable to control the position of the main valve.

The main valve may comprise a spool valve. The main valve may include a valve exit pipe which is connected to an oil inlet pipe for returning oil to a pump oil inlet. The main valve may include a spool biased towards a closed position in which the spool blocks the valve exit pipe. The orifice control system may control the position of the main valve spool. The main valve may be connected to the orifice control system such that as pressure varies across the control valve, the main valve is moved between open and closed positions.

The apparatus may include a force control motor to control the pressure variation across the control valve.

The apparatus may use a mechanical torque to control the pressure variation across the control valve.

The orifice control system may comprise a gearbox; and an electrical generator which is current loaded from the output of the control processor. The gearbox may include a mechanical input driven in use by a drill pipe and a differential output which in use drives the electrical generator. The gearbox may generate a mechanical output torque. The mechanical output torque from the gearbox may provide the mechanical torque for controlling the position of the control valve. The mechanical output torque may be fed to conversion mechanism which converts the torque into a force which is fed to the control valve.

The gearbox may be a differential gearbox which gives a mechanical output torque proportional to the input/output differential torque. The gearbox mechanical output torque may control the pressure variation across the control valve.

The gearbox may be epicyclical in form. The gearbox output torque may appear at the outer concentric gear.

The control valve may be a flap valve. The output torque may appear as a rotation and may be used to drive a moveable element of the flap valve against a control valve orifice outlet to provide pressure change across the control valve to control the position of the main valve.

The control processor may produce an output which is electrically converted to a proportional current sink which provides a load to the generator.

The control valve may be a ball valve. The control valve may be a flap valve.

The apparatus may further comprise a roll sensor system which provides inputs to the control processor. The control processor may include inputs from other sensors and/or sensor systems.

The control processor may be configured to calculate an output signal to limit drill bit torque. The control processor may be configured to calculate an output signal to provide damping against stick-slip oscillations.

The hydraulic pump may comprise an input shaft, for connecting the upstream end of the apparatus in use via a rotatable joint to the downhole end of a drill pipe. The apparatus may be coupled at a downstream end to a bottom hole assembly.

According to a further aspect of the present invention, there is provided an apparatus for providing directional control of bore drilling equipment comprising:

a hydraulic pump having an input shaft for receiving an input torque from a drill pipe and being connected in use to a drilling head; and a control arrangement for varying the rate of fluid flow through the pump;

wherein the control arrangement includes:

a closed loop oil-filled system comprising the hydraulic pump and a main valve, wherein oil from the pump is routed through the main valve before returning to a pump input;

and an orifice control system operable to control the position of the main valve; wherein the orifice control system includes a control valve provided in the closed loop system and connected to the main valve such that, in use, as the pressure across the control valve varies it causes the position of the main valve to change; and wherein the pressure variation across the control valve is controlled by the control processor.

According to a further aspect, there is provided a bore drilling equipment arrangement including a drill pipe, a bottom hole assembly including a drilling head and an apparatus for providing directional control of bore drilling equipment as described above. The hydraulic pump input shaft may be coupled via a rotation joint to the down stream end of the drill pipe and a down stream end of the apparatus may be connected to the bottom hole assembly.

According to a further aspect of the present invention, there is provided a method of providing directional control to a bore drilling arrangement comprising:

providing a hydraulic pump, connected at its downstream end to a bottom hole assembly and having an upstream input shaft indirectly coupled to a down hole end of a drill pipe;

providing a closed loop oil system including: the pump, a main valve through which oil is pumped before returning to the pump; and an orifice control system for varying the position of the main valve;

receiving inputs relating to the orientation and position of the bottom hole assembly and drill pipe into a control processor;

calculating an output signal for limiting drill bit torque and/or to provide damping against stick slip oscillations;

feeding the output signal to the orifice control system; and altering the position of the main valve.

A control valve may be provided in the closed-loop oil system, the control valve being connected to the main valve; and being operable to control the position of the main valve. The step of altering the position of the main valve may be achieved by altering the pressure variation across the control valve.

The output signal may be fed to a force control motor in the orifice control system. The step of altering the position of the main valve may include using the force controller to apply a force to vary the pressure across the control valve.

The step of altering the position of the main valve may include providing a mechanical torque to the control valve.

The step of altering the position of the main valve may include:

providing a differential gearbox and an electrical generator;

using the drill pipe to drive the differential gearbox input;

driving the generator with the gearbox;

electrically converting the control signal to a proportional current sink to current load the electrical generator; and using the mechanical output torque of the gearbox output to control pressure across the control valve.

According to a further aspect of the present invention, there is provided a method of operating a bore drilling arrangement comprising a drill pipe and bore hole assembly, the method including defining an intended borehole course;

driving the drill pipe at speed above an upper threshold rpm in a straight through drilling mode;

halting the drill pipe and conducting surveys;

determining whether the borehole is off-course;

if the borehole is off course, driving the drill pipe at a speed below a lower threshold rpm to vary the tool face in a set tool face mode;

halting the drill pipe for a period greater than a predefined wait time;

sensing that the drill pipe has halted for a period greater than the predefined wait time and storing the current tool face as a tool face datum;

retaining the tool face datum until the drill pipe halt time exceeds the predefined wait period;

driving the drill pipe at a speed below the upper threshold rpm and above the lower threshold rpm to in a hold tool face mode;

halting the drill pipe for a period less than the predetermined wait time, conducting surveys; and determining whether the borehole is off-course;

if the borehole is on-course, driving the drill pipe at speed above the upper threshold rpm in a straight through drilling mode; and if the borehole remains off-course, driving the drill pipe at a speed below the upper threshold rpm and above the lower threshold rpm to in the hold tool face mode using the stored tool face datum.

This method allows, the operator can make a course correction and set the tool face datum. The operator can then proceed with drilling by alternating between the hold tool face mode and the straight through drilling mode without having to continually adjust the tool face.

The drill pipe down hole speed may be determined by and stored in a control processor. The control processor may be configured to use the determined drill pipe down hole speed to determine a mode of operation.

The drill pipe downhole speed may determined from a generator speed minus the bottom hole assembly rate. It will be appreciated that other methods may be used to determine or calculate the drill pipe downhole speed.

The predefined wait time may be between 30 seconds and 60 seconds. The predefined wait time may be 30 seconds. The upper threshold may be approximately 30 rpm. The lower threshold may be approximately 10 rpm. In the hold tool face mode, the drill pipe may be driven at a speed substantially mid way between the upper threshold and the lower threshold. In the hold tool face mode, the drill pipe may be driven at approximately 20 rpm.

The method may further comprise the drill pipe halting the drill pipe and conducting surveys;

determining whether the borehole is off-course;

if the borehole is off course by a different amount, driving the drill pipe at a speed below a lower threshold rpm to alter the tool face in a set tool face mode;

halting the drill pipe for a period greater than a predefined wait time;

sensing that the drill pipe has halted for a period greater than the predefined wait time and storing the current tool face as a tool face datum.

In this way, the operator can make a course correction and reset the tool face datum.

Whilst the invention has been described above, it extends to any inventive combination of features set out above or in the following description or drawings.

BRIEF DESCRIPTION OF THE DRAWINGS

Specific embodiments of the invention will now be described in detail by way of example only and with reference to the accompanying drawings in which.

DETAILED DESCRIPTION OF EXEMPLARY EMBODIMENTS

In the following embodiments, the term "upstream" refers to the surface facing end of the drilling apparatus and the terms "downstream" and "down hole" refers to the remote end of the drilling apparatus.

Figure 1:
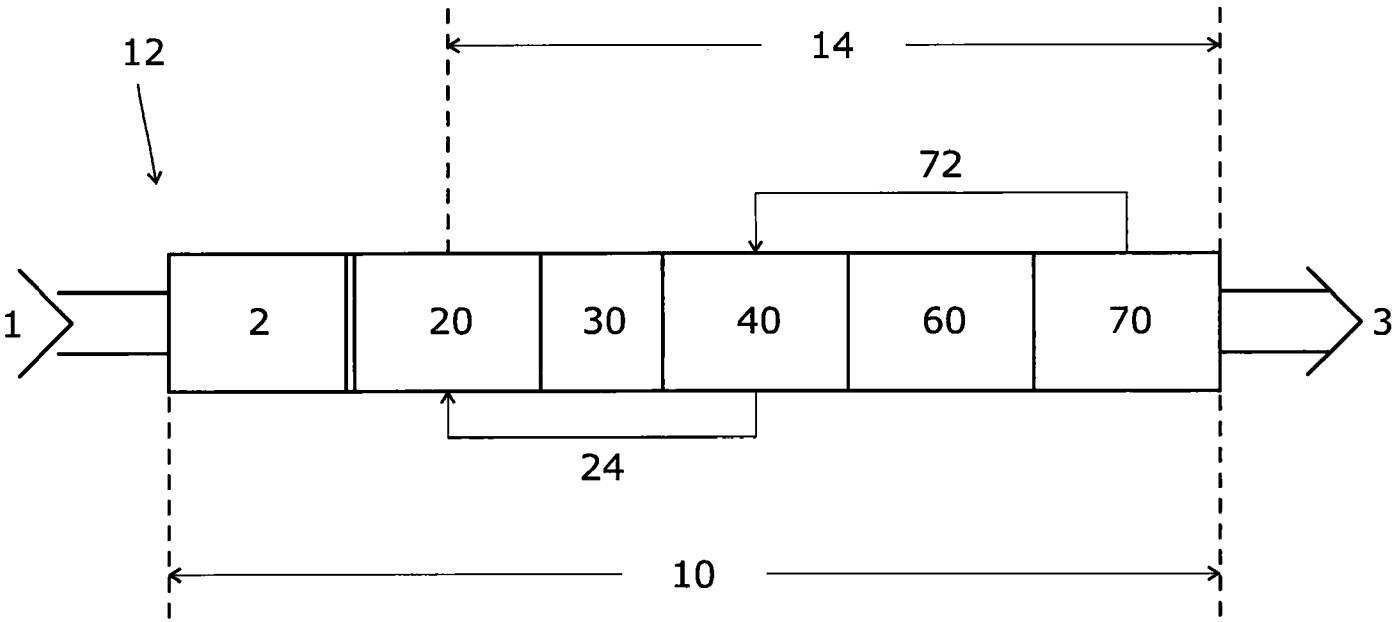
FIG. 1 is a schematic representation of an apparatus according to an embodiment of the invention provided mounted in use in a bore drilling apparatus.

FIG. 1 shows an apparatus 10 for controlling the torque of a drill pipe, also known as a drill pipe torque control device (DPTC device or DPTCD), according to an embodiment of the invention.

In use, as shown in FIG. 1, a drill pipe drive 1 is connected via a rotating joint 2 to an upstream end 12 of the DPTC device. This means that the DPTC device is isolated from the drill pipe drive 1. A bottom hole assembly (BHA) 3 is connected to a downstream end 14 of the DPTC device. The BHA may be in the form of a rotary steering assembly or the more conventional bent housing motor.

The DPTC device comprises a positive displacement pump 20, a main spool valve 30, an orifice control system 40, a roll sensor system 60 and a control processor 70. The control processor provides an input 72 to the orifice control system.

Figure 2:
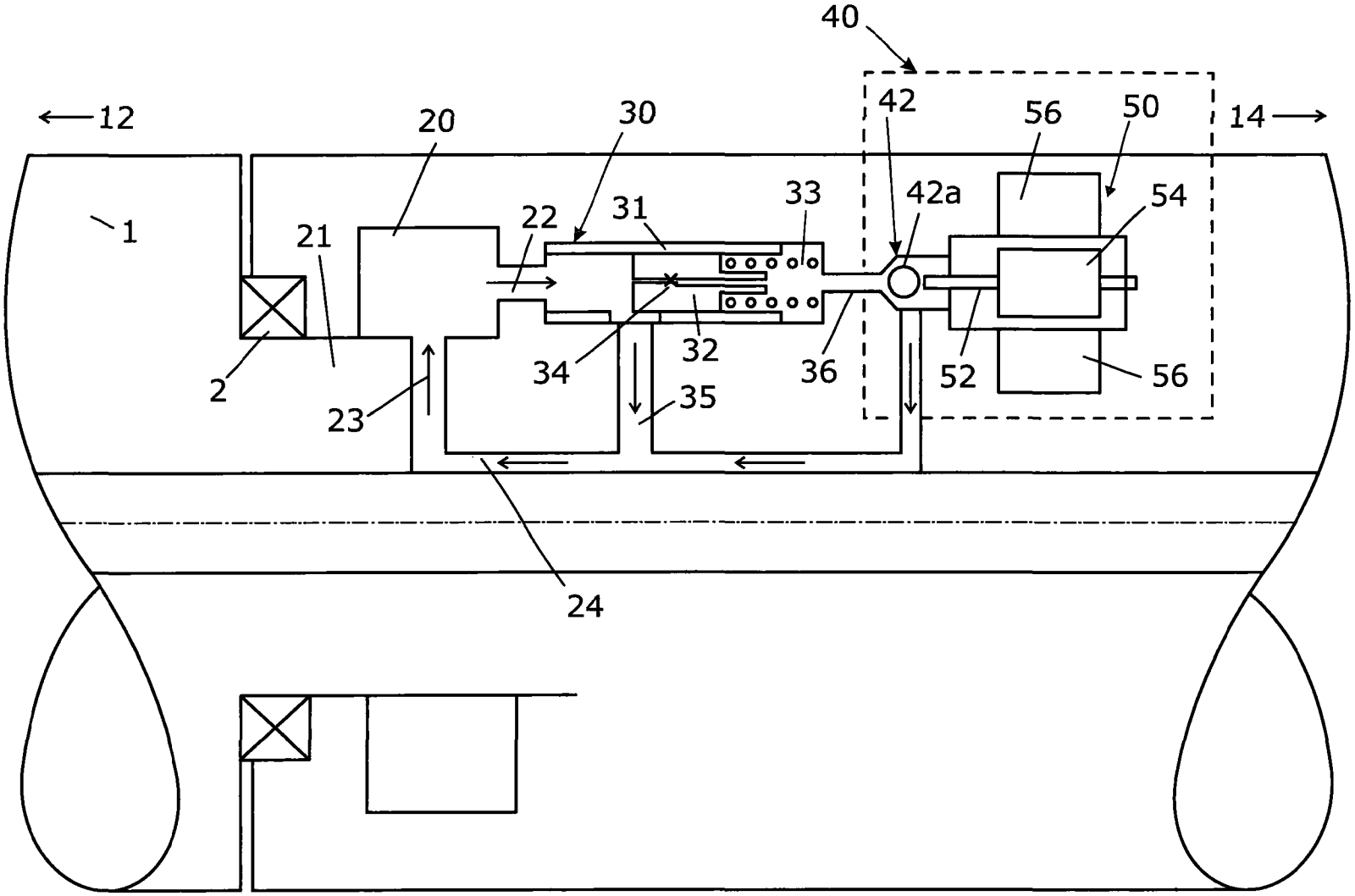
FIG. 2 is more detailed schematic view of the apparatus of FIG. 1.

FIG. 2 shows a more detailed schematic of the DPTC device. The pump 20 includes an input 21 which in use is connected to drill pipe 1 via the rotating joint 2, thereby coupling the DPTC device to the downhole end of the drill pipe 1 such that the drill pipe 1 drives the input of the pump 20.

The DPTC device includes a closed loop oil system. The pump 20 includes a pump oil outlet 22 which leads to the main valve 30 and an oil inlet 23 fed by an oil return pipe 24. The main spool valve 30 comprises a fixed valve sleeve 31 and a spool 32. The spool 32 has a centre through-hole which incorporates a fixed orifice 34 leading to a downstream end 36. The main valve 30 also includes a valve exit pipe 35 which leads to the oil return pipe 24. The spool 32 is biased towards a closed position by a spring 33. The downstream end 36 of the main valve 30 is connected to the orifice control system 40.

In this embodiment, the orifice control system 40 includes a moving magnet linear force motor 50, otherwise known as a magnet and coil force motor. The motor includes a moving permanent magnet 54 attached to an armature 52, and fixed drive coils 56 which encase the moving magnet 54. A control valve (or pilot valve) 42 is provided upstream of the motor 50. The control valve 42 includes an inlet 42*a* is connected to the downstream end 36 of the main valve 30 and an outlet 42*a* which leads to the oil return pipe 24. In the embodiment shown, the control valve 42 is a ball valve having a ball 42*a*.

The armature 52 and magnet 54 are moveable between a non loading, down stream position and an upstream loading position in which the armature 52 contacts and exerts an upstream force on the ball 42*a*. The fixed drive coils 56 receive a drive current from the control processor 70 and exert axial force on the control valve 42. This force produces a pressure variation across the control valve 15 42, and moves the ball 42*a* axially between a closed position in which the inlet 42*a* is blocked and an open position.

The position of the valve spool 32 in the main valve 30 is controlled by the pressure drop across it and the closing force of the spring 33. When the ball valve 42 is driven to the closed position the pressure difference across the spool 32 closes off the exit pipe 35 and the pump pressure drop is increased. This increases the torque transmitted to the BHA. When the ball valve 42 is moved to the open position the spool 32 opens the exit pipe 35 and the pump pressure drop is decreased.

In another embodiment (not shown) the control valve is a flap valve which is moved between open and closed positions by the armature of the orifice control system. A mechanism may be provided which converts the axial motion of the armature into rotational motion for driving the flap valve against an orifice outlet to provide a control pressure change to control the main spool valve.

The force motor valve receives an orifice control signal 72 from the control processor 70 which has inputs from the roll sensor system 60. Various algorithms can be used in control processor to provide appropriate control signals to the orifice control system in order to limit drill bit torque and/or provide damping against stick-slip oscillations. Further, when a bent housing motor drill is used algorithms can be used in order to hold a constant tool face whilst maintaining drill pipe rotation.

Figure 3:
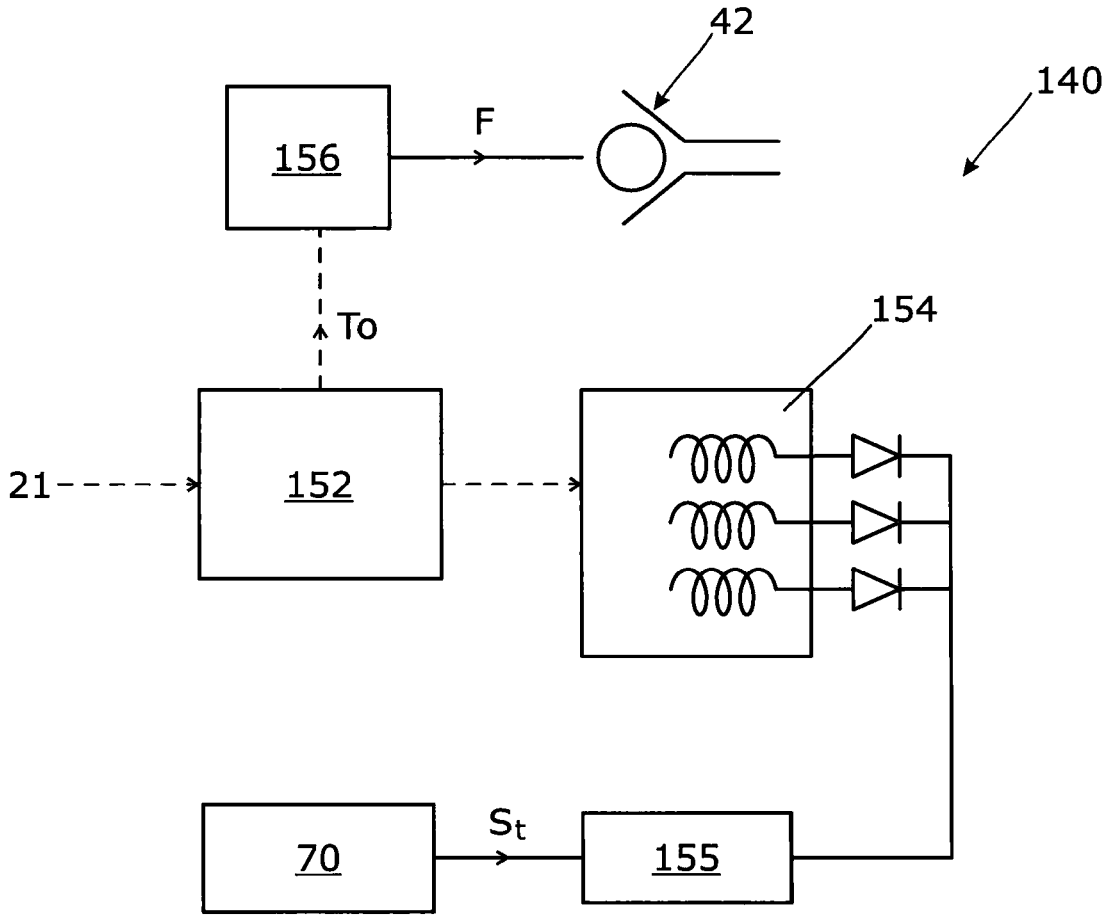
FIG. 3 is a schematic detailed view of a second embodiment of the invention.

FIG. 3 shows a second embodiment of an orifice control system 140 for controlling the pressure variation across the control valve 42.

The orifice control system 140 includes a gearbox 152, an electrical generator 154, a torque conversion mechanism 156, and a control valve 42.

The gearbox input 152*a* is driven by a semi-flexible shaft (not shown) running co-axially to the DPTC device, the semi-flexible shaft being driven by and connected to the drill pipe drive 1. This means that the gear box input 152*a* is driven at the same rotational rate as the drill pipe 1.

The gear box 152 has a step up ratio of between 2:1 and 10:1. It has been found that a particularly suitable ratio is 6.25:1. The gearbox output 152*b* drives the generator 154. The control processor 70 (shown in FIG. 1) produces an output $S_t$ which is electrically converted 155 to a proportional current sink which provides a load to the generator 154. A current sink load is used to make the generator torque to processor output independent of generator speed.

The gearbox 152 has a differential configuration and may be epicyclic in form. By virtue of being a differential device, the gear box 152 produces a differential output which consists of a mechanical torque To which is proportional to electrical load on the generator 154. The mechanical torque output To (from the gearbox) is converted by a simple mechanical torque conversion mechanism 156 to a force F which is then applied to the control valve 42. In this embodiment, the force F axially shifts the ball 42*a* of the ball valve 42. The torque conversion mechanism 156 can by a simple connecting lever, or any other suitable known device.

It will be understood that the orifice control system 140 can be used in the arrangement shown in FIGS. 1 and 2.

In another embodiment (not shown) the control valve is a flap valve which is moved between open and closed positions by the force F. In this arrangement, the output torque from the gear box is converted into a rotational force, which used to drive an element of a flap valve against an orifice outlet to provide a control pressure change to control the main orifice valve.

In use, the DPTC device is connected at its upstream end to the down stream end of the drill pipe 1 via the rotatable joint 2 (as shown in FIG. 1). The down stream end of the DPTC device is coupled to the BHA.

The DPTC device can be used in several modes, and the mode of operation is determined by the control processor, as explained below.

The speed of the drill pipe at the surface can be measured. But it is not possible to directly measure the downhole drill pipe speed. As explained above, the drill pipe drives the generator of the DPTC device. The generator speed and the BHA rate are known. The control processor can use these values to determine the hole drill pipe speed according to the relationship below:

Drill pipe downhole speed (DPDS)=Generator speed−BHA rate

The determined DPDS is used by the control processor to determine the mode 5 of operation (see Table 1).

TABLE 1

| Drill pipe downhole speed (DPDS) | | DPTC |
|---|---|---|
| Band | Typical value (rpm) | Operating Mode |
| Low range | 0-10 | A Set tool face |
| Mid-range | 10-30 | B Hold tool face |
| High range | Above 30 | C Straight through |

When the DPTC device is operated to drill a straight bore the maximum torque is driven through the drill pipe and the downstream drill pipe speed is above 30 rpm.

After a period of drilling, the drill pipe is halted. Surveys are taken with known Measurement While Drilling (MWD) tools. MWD tools use accelerometers and magnetometers to measure inclination and azimuth and are generally capable of taking directional surveys in real time. The MWD data is then transmitted back to the surface. At the surface the survey results are reviewed and calculations can be made to determine whether the borehole is on-course or off-course. If the borehole is off course the required deviation to correct the bore hole course is calculated.

If is determined following a survey that the borehole is off course and course deviation is necessary, the tool face is reset by moving the drill pipe from the surface to obtain the correct tool face in order to correct the direction of the bore drilling. The drill pipe downhole speed is maintained within the low range, typically 2-3 rpm, whilst the tool face is adjusted. This corresponds to mode A—set tool face.

Once the tool face has been set, the downhole assembly is halted for a predefined wait period. The pre-defined wait period is typically between 30 seconds and 60 seconds. However, it will be appreciated that this period can be adjusted depending on the particular operational requirements. The control processor recognizes that the assembly has halted for the wait period, and it takes the tool face setting and records it as a datum. The control processor stores and retains the datum until the downhole assembly is again halted for the predetermined wait period. This means that the tool face datum is conserved as long as the downhole assembly halt time does not exceed the wait period.

The drill pipe is then rotated and the whole assembly driven forward and the drill pipe downhole speed is maintained in the mid-range. The drill pipe down hole speed in this mode should be distinct from the two threshold values. The preferred speed is the mid-point between the two threshold values. Therefore, if the range is 10 to 30 rpm, an optimum speed in this mode will be approximately 20 rpm. This corresponds to mode B—hold tool face.

During operation in mode B—hold tool face, the control processor varies the position of the control valve thereby varying the load on the pump in order to react the torque and maintain the tool face in the datum position. In this mode, the drill pipe can be rotationally driven whilst the tool face is set to correct the course. In other words, the invention provides a significant advantage over previous arrangements.

After a defined drilling period operating in mode B another survey is carried out and results transmitted to the surface as before. The downhole assembly is halted for a time less than the wait period, and the previously defined datum is retained in the control processor. If the survey indicates that the bore hole is still off course and further is correction is required in the same direction no change is required to the tool face because the datum is maintained for the subsequent drilling period and drilling continues at a mid range drill pipe downhole speed as before.

If after a survey it is determined that no further deviation is required, the assembly is operated in mode C—straight through drilling by maintaining the drill pipe downhole speed in the high range, which in the example shown is above 30 rpm.

Alternatively, the operator may chose to proceed in mode C for a short period, and then conduct further surveys to determine whether the correct course has been achieved. During the survey, the downhole assembly is halted for a period less that the pre-determined wait period, and the tool face datum remains set. If the borehole is still off-course, the drill pipe can then be rotated in mode B for a further period, at the previously set datum, to make additional course correction.

Therefore, the invention provides a significant advantage over known methods since there is no need for the operator to recalculate and reset the tool face after subsequent sections of drilling ahead (straight through drilling) and path correction drilling. This means that the drilling of the bore hole can proceed more efficiently and quickly.

The invention provides an apparatus which can be operating by driving and rotating the drill pipe drilling ahead (straight through mode) and path correction drilling (hold tool face mode), further more the datum tool face is conserved as the mode of drilling is varied between these modes.

The DPTC device as described in the embodiments above can be provided as a self-contained unit which is mounted in use between the lower end of the drill pipe and the upper end of the Bottom Hole Assembly (BHA). Alternatively, the DPTC device can be formed as an integral component of the BHA or integrally formed with the rotating joint and/or drill pipe.

While the invention has been described above with reference to one or more preferred embodiments, it will be appreciated that various changes or modifications may be made without departing from the scope of the invention as defined in the appended claims.

The invention claimed is:

1. An apparatus to provide directional control of bore drilling equipment, the apparatus comprising:

a hydraulic pump comprising an input shaft configured to receive an input torque from a drill pipe and configured to connect to a drilling head; and a control arrangement configured to vary a rate of fluid flow through the hydraulic pump;

wherein the control arrangement comprises:

a closed loop oil-filled system comprising the hydraulic pump and a main valve, wherein, within the closed loop oil-filled system, an outlet of the hydraulic pump leads to the main valve and the main valve includes an exit pipe that leads to an inlet of the hydraulic pump; and an orifice control system comprising a gearbox and an electrical generator, wherein the gearbox is configured to produce a mechanical output torque to control a position of the main valve in response to an input signal from a control processor, and wherein the electrical generator is current loaded from the output of the control processor.

2. The apparatus of claim 1, wherein the orifice control system comprises a control valve provided in the closed loop system and connected to the main valve;

wherein the control valve is configured to control the position of the main valve.

3. The apparatus of claim 2, wherein the control valve is configured to alter the position of the main valve based on a pressure variation across the control valve.

4. The apparatus of claim 3, wherein the gearbox includes a mechanical input configured to be driven by the drill pipe, and a differential output that is configured to drive the electrical generator; and wherein the mechanical output torque of the gearbox is configured to alter the pressure variation across the control valve.

5. The apparatus of claim 4, wherein the mechanical output torque of the gearbox is proportional to an input/output differential torque of the gearbox.

6. The apparatus of claim 4, wherein the gearbox is epicyclic in form.

7. The apparatus of claim 6, wherein the control valve is a flap valve.

8. The apparatus of claim 4, wherein the control processor is configured to produce an output that provides a load to the generator.

9. The apparatus of claim 2, wherein the control valve is a ball valve.

10. The apparatus of claim 1, wherein the main valve comprises a spool valve.

11. The apparatus of claim 1, further comprising a roll sensor system configured to provide inputs to the control processor.

12. The apparatus of claim 1, wherein the control processor is configured to calculate an output signal to limit drill bit torque and/or provide damping against stick-slip oscillations.

13. The apparatus of claim 1, wherein the input shaft is configured to connect to the downhole end of the drill pipe via a rotatable joint; and wherein the apparatus further comprises a downhole end that is configured to be coupled to a bottom hole assembly.

14. A method of providing directional control to a bore drilling arrangement, the method comprising:

providing a hydraulic pump, wherein a downstream end of the hydraulic pump is connected to a bottom hole assembly, and wherein an upstream input shaft of the hydraulic pump is indirectly coupled to a down hole end of a drill pipe;

providing a closed-loop oil system including: the hydraulic pump, a main valve through which oil is pumped before returning to the pump; and an orifice control system for varying the position of the main valve;

receiving inputs relating to the orientation and position of the bottom hole assembly and drill pipe into a control processor;

calculating an output signal with the control processor for limiting drill bit torque and/or to provide damping against stick slip oscillations;

feeding the output signal to the orifice control system;

driving a differential gearbox with the drill pipe;

driving an electrical generator with the gearbox; and applying a mechanical output torque of the gearbox to a control valve of the orifice control system to alter the position of the main valve.

15. The method of claim 14, wherein the control valve is connected to the main valve; and wherein applying a mechanical output torque of the gearbox to the control valve further comprises:

altering a pressure variation across the control valve as a result of the mechanical output torque; and altering the position of the main valve as a result of the altered pressure variation across the control valve.

16. The method of claim 14, further comprising:

electrically converting the output signal to a proportional current sink; and current loading the electrical generator with the proportional current sink.

* * * * *